United States Patent [19]

Kerr

[11] Patent Number: 5,062,165

[45] Date of Patent: Nov. 5, 1991

[54] BEDSIDE TOILET INCORPORATING OVERHEAD HOIST

[76] Inventor: Harry D. Kerr, 4641 N. Ardmore Ave., Whitefish Bay, Wis. 53217

[21] Appl. No.: 562,895

[22] Filed: Aug. 3, 1990

[51] Int. Cl.[5] ..... A61G 9/00

[52] U.S. Cl. ..... 4/480; 4/483; 4/484; 5/86; 5/90

[58] Field of Search ..... 4/460, 478, 479, 480, 4/483, 484; 5/81 R, 81 B, 83, 86, 87, 90; 414/921

[56] References Cited

U.S. PATENT DOCUMENTS

| | | | |
|---|---|---|---|
| 787,760 | 4/1905 | Higgins | 5/88 X |
| 1,857,031 | 5/1932 | Schaffer | 5/86 |
| 2,500,544 | 3/1950 | Haskins | 4/480 |
| 2,869,614 | 1/1959 | Wamsley | 4/480 X |
| 3,050,741 | 8/1962 | Coleman | 4/480 |
| 4,011,610 | 3/1977 | Parker, III | 5/90 |
| 4,199,829 | 4/1980 | Watanabe et al. | 5/81 R |
| 4,685,159 | 8/1987 | Oetiker | 5/90 X |
| 4,760,615 | 8/1988 | Furniss | 5/68 X |
| 4,847,929 | 7/1989 | Pupovic | 5/90 X |
| 4,920,587 | 5/1990 | Kerr | 4/480 |

FOREIGN PATENT DOCUMENTS 2929090 2/1981 Fed. Rep. of Germany ..... 5/83

*Primary Examiner*—Henry J. Recla
*Assistant Examiner*—Robert M. Fetsuga
*Attorney, Agent, or Firm*—Andrus, Sceales, Starke & Sawall

[57] ABSTRACT

The bedside toilet includes an elongated platform including a posterior section, a back section, and a leg section, which are hinged together so that the platform can be moved from a horizontal position to an operable position in which the back section extends upwardly from the posterior section and the leg section extends downwardly. The posterior section includes a toilet. The posterior section is supported in cantilevered fashion from a supporting structure which is carried by a trolley that rides on an overhead track. The supporting structure is composed of two sections that can be moved relative to each other to vary the distance between the track and the platform. A power mounted mechanism, such as a fluid cylinder, interconnects the posterior section with the back section and the leg section, respectively, and individual operation of the cylinders can permit the back section and leg section to pivot with respect to the posterior section.

16 Claims, 3 Drawing Sheets

FIG. 1
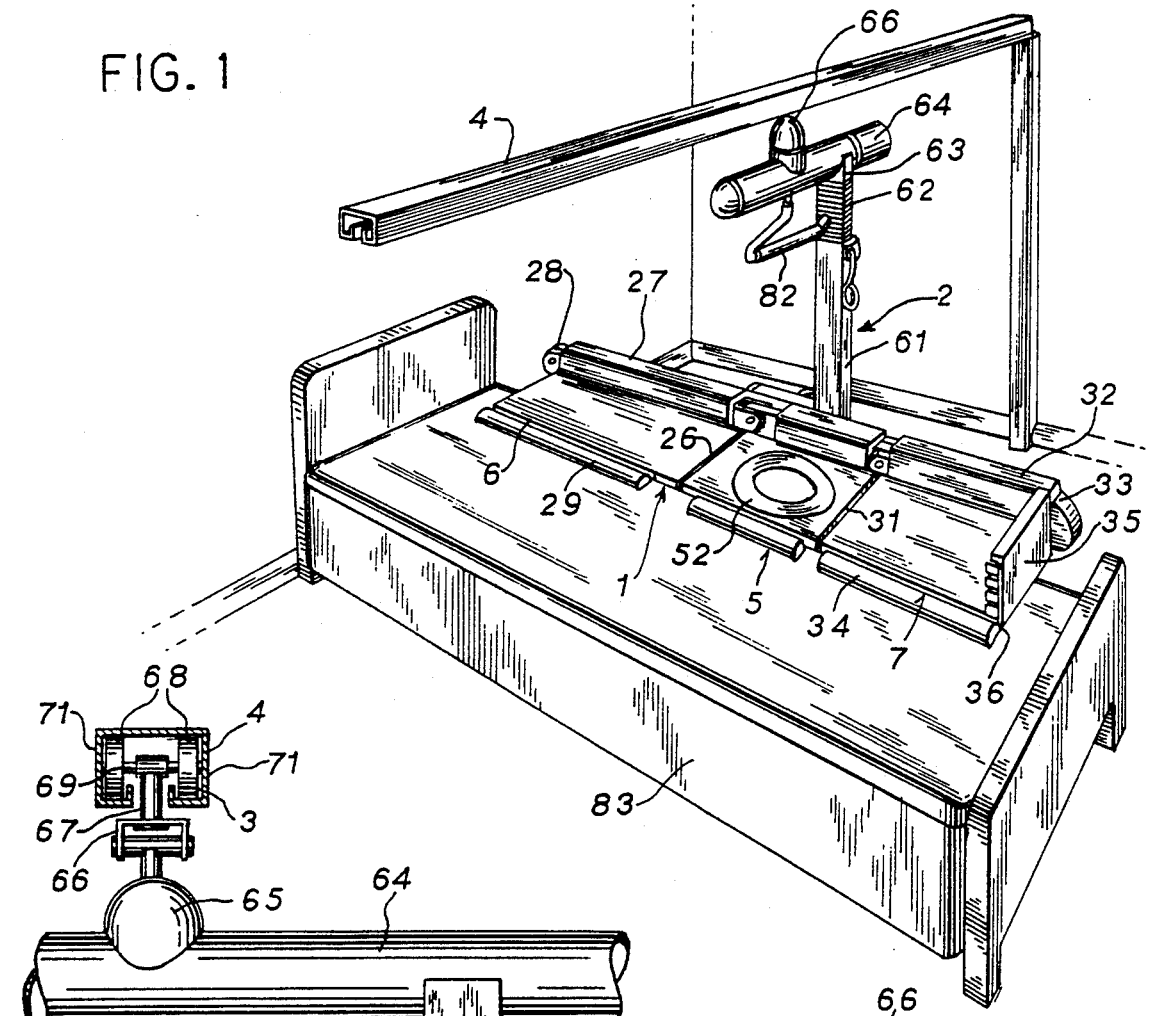
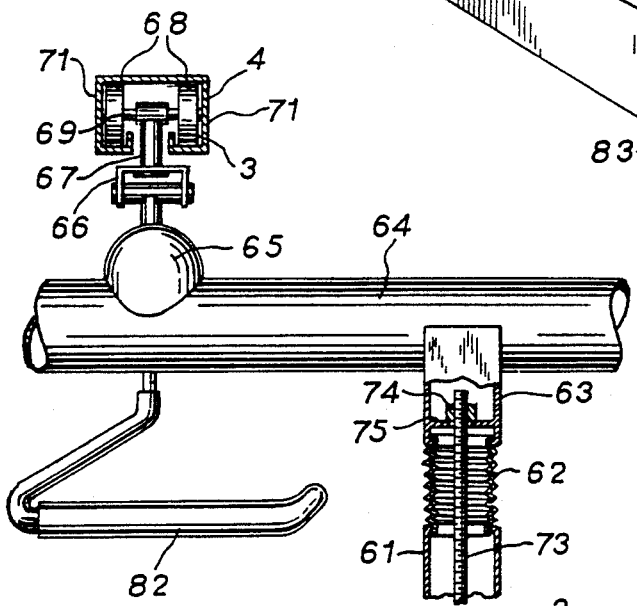
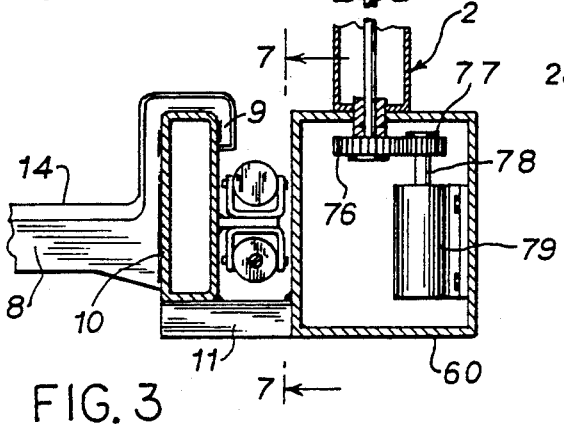
FIG. 3
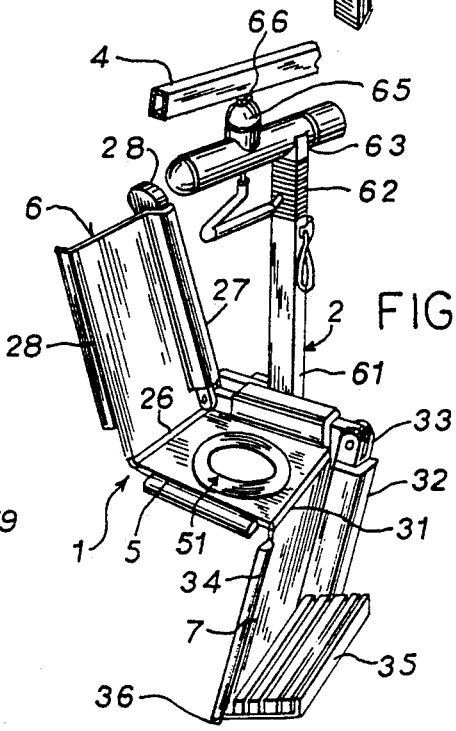
FIG. 2

FIG. 4
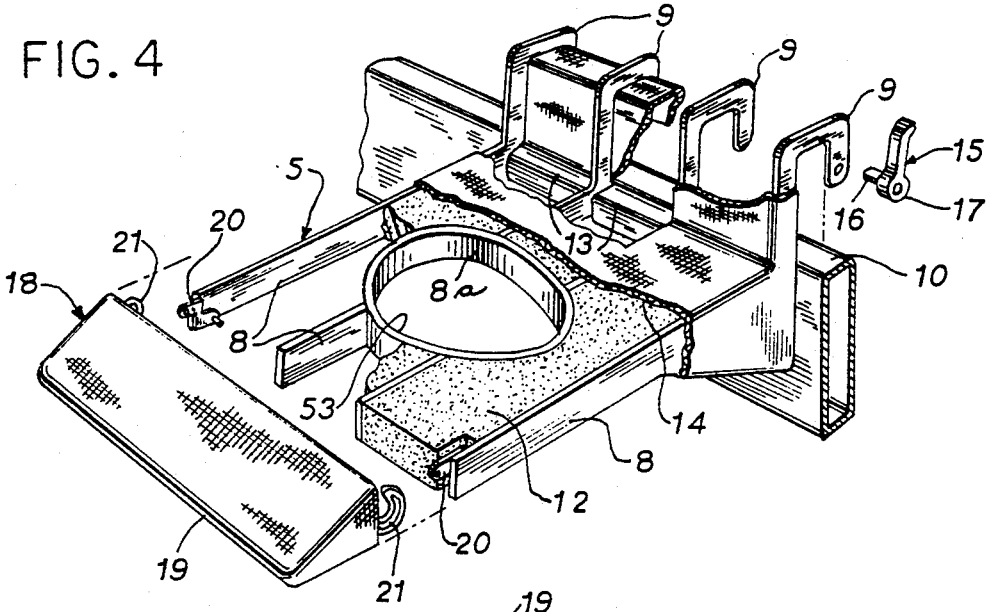
FIG. 5
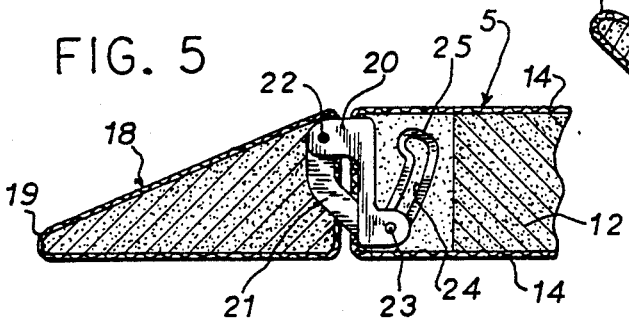
FIG. 6
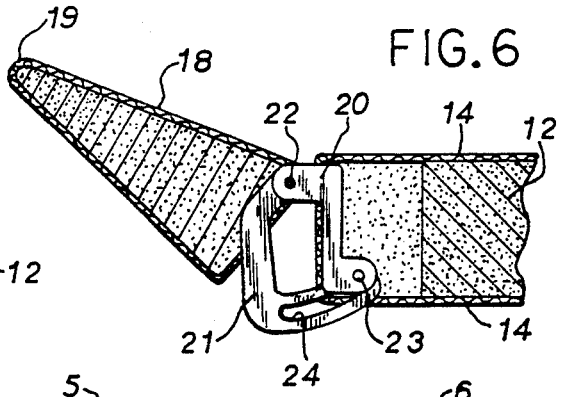
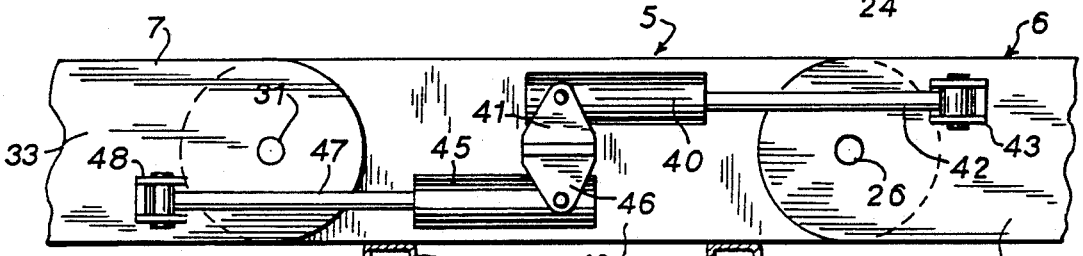
FIG. 7
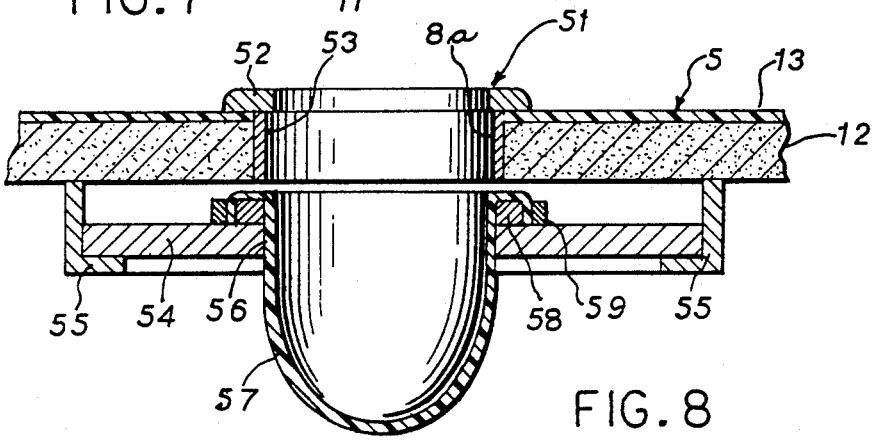
FIG. 8

BEDSIDE TOILET INCORPORATING OVERHEAD HOIST

BACKGROUND OF THE INVENTION

A difficult problem in the care of a disabled person is helping the person do the daily array of routine tasks. Prominent among these tasks are toileting, bathing, eating, and moving from place-to-place. Many disabled persons live at home and are cared for my an elderly family member, usually female. The care giver is not equipped to lift the patient and the inability to do so may necessitate home aids, or alternately, placement of the disabled person in a nursing home.

Toileting assistance is especially demoralizing and degrading for the disabled person and frequently is disgusting to the care giver. Humiliations to the patient include lack of privacy, and the necessity for assistance with each mundane need. This contributes to the development of depression, so common in home care patients.

The most common method of managing a bowel movement for a disabled person is through use of a bedpan. Assistance is normally required in getting the patient properly positioned on the bedpan and balance is difficult. The sitting position employed with a bedpan compresses the buttocks interfering with the normal anal muscle function. In place of a bedpan, the patient can be helped or lifted from the bed and positioned on a bedside commode. This requires considerable assistance which is not always available. In place of manual assistance, canvas slings have been used with hydraulic lifts and davits to raise the patient out of the bed, swing the patient through the air and lower the patient onto the bedside commode. However, it is difficult to get the patient into and out of the sling, and this process requires a substantial period of time, which may not be rapid enough to prevent soiling of the bed, sling, or other equipment.

SUMMARY OF THE INVENTION

The invention relates to a bedside toilet construction which incorporates an overhead hoist. The construction includes an elongated platform to support a patient and composed of a posterior section, a back section and a leg section, which are hinged together and movable between a horizontal position and an operative position where the back section extends upwardly from the posterior section and the leg section extends downwardly.

A toilet is associated with the posterior section and includes a seat that is mounted on the upper surface of the posterior section. A tray is mounted for sliding movement beneath the posterior section and carries a receptacle, such as a plastic bag, which receives the fecal material. After the bowel movement, the bag can be sealed and discarded.

The platform is mounted in cantilevered fashion from a supporting structure and the supporting structure, in turn, is carried by a trolley which rides on an overhead track. The supporting structure is composed of two vertical sections that can be moved relative to each other to vary the distance between the track and the platform.

Power operated mechanisms, preferably fluid cylinders, interconnect the posterior section with the back section and with the leg section, respectively, and the cylinders can be individually operated to pivot the back and leg sections relative to the posterior section.

In operation, the platform in a horizontal position is moved manually along the overhead track to a position over the bed and the platform is then lowered, so that it is located on the bed next to the patient. The patient is rolled onto the platform, the platform is elevated slightly above the bed and then moved along the overhead track to a location removed from the bed.

The platform is then moved to the operating condition where the back extends upwardly from the posterior section and the leg section extends downwardly, so that the patient is then in a comfortable and proper position for the bowel movement. After completion of the bowel movement, the receptacle containing the fecal material is sealed and removed.

The construction of the invention provides a mechanism for readily transferring a bed-ridden patient from the bed to the toilet without the need for heavy labor expenditure. The invention has particular use for private homes and can also be used in hospitals, nursing homes, and the like.

As both the back section and the leg section can be pivoted relative to the posterior section, the patient is in a normal comfortable position for the bowel movement.

As a safety feature, flip-up, wedge-shaped safety lips are connected to the outer side edge of the platform. With the wedge-shaped lips extended, the patient can be readily rolled or moved onto the platform and the lips are then moved to an upper or angular position which steady the patient and prevent the patient from rolling from the platform, as the platform is moved along the overhead track.

With the use of the invention, there are no support cables which might entangle the patient.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the apparatus of the invention with the platform shown in the horizontal position;

FIG. 2 is a view similar to FIG. 1 showing the platform in the operative position;

FIG. 3 is a fragmentary vertical section of the apparatus;

FIG. 4 is an exploded perspective view with parts broken away showing the construction of the platform sections;

FIG. 5 is a fragmentary vertical section showing the connection between the lip and the platform with the lip shown in the extended position;

FIG. 6 is a view similar to FIG. 5 showing the lip in the angular position;

FIG. 7 is an elevation showing the fluid cylinders for pivoting the back and leg sections;

FIG. 8 is a vertical section of the posterior section of the platform; and

DESCRIPTION OF THE ILLUSTRATED EMBODIMENT

Figure 9:
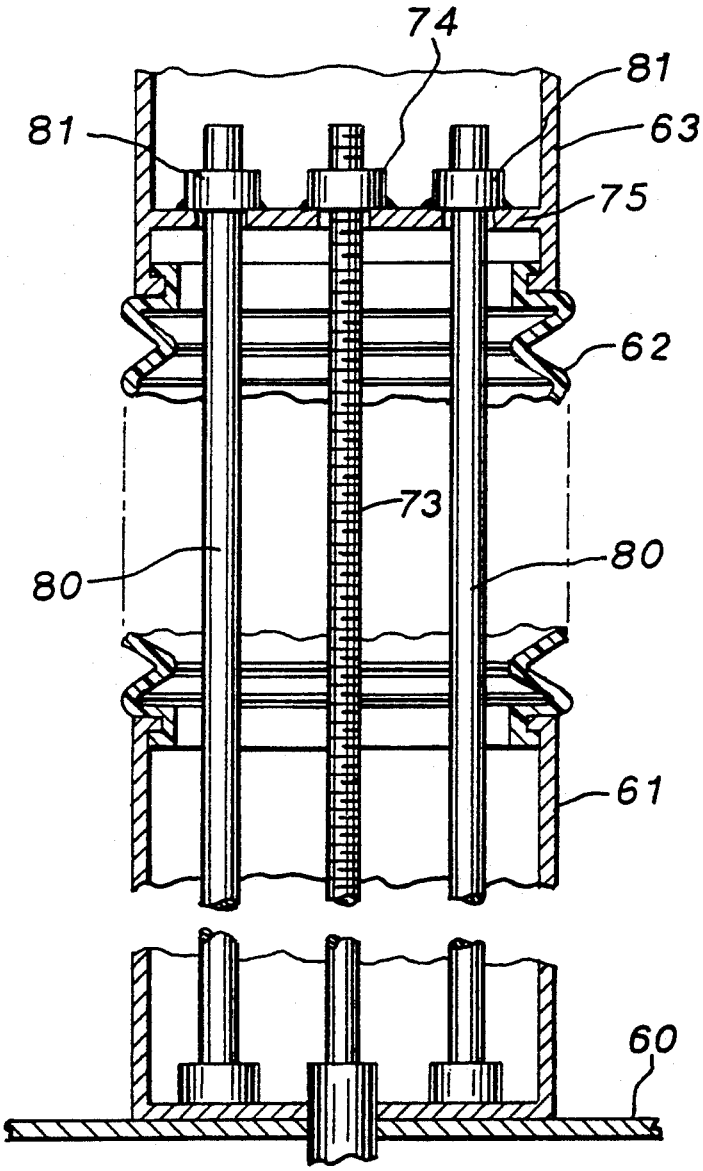
FIG. 9 is a vertical section of the drive for raising and lowering the platform.

The bedside toilet construction of the invention includes an elongated platform 1 to support a patient, and the platform is carried in cantilever fashion from a support structure 2. Support structure 2, in turn, is suspended from a trolley 3, which rides on an overhead track 4. Through the trolley arrangement, the platform 1 can be moved manually along the overhead track 4.

Platform 1 is composed of a posterior section 5, a back section 6, and a leg section 7. The back section 6 and leg section 7 can be pivoted with respect to the posterior section 5, so that the platform can either be in a horizontal position, as shown in FIG. 1, or a pivoted operative position, as shown in FIG. 2, in which the back section extends upwardly from the posterior section and the leg section extends downwardly.

As best illustrated in FIG. 4, posterior section 5 includes a central annular member 8*a* that defines a toilet opening, as will be hereinafter described, and a series of parallel spaced arms 8. The inner end of each arm defines a hook 9, which is removably engaged with a horizontal rail 10. Rail 10 is supported on horizontal beam 11, which extends outwardly in cantilevered fashion from the support structure 2.

A layer of cushioning material, such as foam, rubber or plastic 12, is located outwardly of member 8*a* between the ribs or arms 8. As shown in FIG. 4, the inner ends of arms 8 are spaced apart by spacers 13 and a fabric or plastic cover 14 encloses the arms 8 and cushioning material 12.

To secure the posterior section 5 to rail 10, a locking mechanism is employed which can take the form of a cam lock 15, which is mounted through pin 16 to the hook 9 on one of the arms 8. By rotating cam lock 15, the cam surface 17 will wedge against the side of the rail 10 to secure the section 5 to the rail.

A lip 18 is mounted on the outer side edge of section 5. Lip 18, as shown in FIG. 4–6, is composed of foam plastic material covered with a fabric covering and is generally wedge-shaped in cross section and has a tapered outer edge 19. To pivot lip 18 to section 5, a Z-bracket 20 is secured to each outer arm 8 of section 5, while a pair of curved or arcuate locking members 21 are attached to the lip 18, and are pivotally connected to the respective Z-brackets 20 about pivots 22. Each Z-bracket carries a pin 23 which rides in a groove 24 in the respective member 21. As lip 18 is pivoted upwardly relative to section 5, pin 23 will ride in groove 24 and when the lip has been pivoted to an angular position, as shown in FIG. 6, the pin will fall into the angular end 25 of groove 24, which will serve to lock the lip in the inclined or angular position.

The wedge-shape of lip 18 aids in rolling or moving the patient from the bed onto platform 1, and when the lip is in the angular position it will prevent the patient from rolling from the platform as the platform is moved along the overhead track 4.

Back section 6 is similar in construction to posterior section 5, and is hinged to the section 5 by a hinge 26, which permits the back section to be moved from the horizontal to an angular position of about 75° with respect to the posterior section. As in the case of posterior section 5, back section 6 includes a series of spaced parallel arms which terminate in hooks 27 that are engaged with rail 28. In addition section 6 includes a hinged side lip 29 similar to lip 18.

Leg section 7 is pivoted to posterior section 5 by a hinge 31 and is movable from a horizontal position to an over-vertical position, as shown in FIG. 2. Leg section 7 can be constructed in a manner similar to posterior section 5 and includes a series of spaced parallel arms which terminate in hooks 32 that engage horizontal rail 33. In addition, a lip 34, similar in construction to lip 18, is attached to the side edge of the section 7.

A foot rest 35 can be connected to the opposite edge of leg section 7 by a hinge 36 and the foot rest can be moved from a folded position where it is generally parallel to section 7 to an extended position, as shown in FIG. 2. If desired, the foot rest can be adjustable to accommodate the height of the patient and the adjustment for the foot rest can be constructed in the manner shown in U.S. Pat. No. 4,920,587.

To pivot the back section 6 relative to posterior section 5, one end of a fluid cylinder 40 is pivotally connected to lugs 41 on rail 10. Piston rod 42, which is slidable relative to cylinder 40, is pivotally connected to one end of a bracket 43, on rail 28 of section 6. With this construction, retraction of piston rod 42 will pivot back section 6 from a horizontal position to an angular position, as shown in FIG. 2.

To pivot leg section 7 relative to posterior section 5, one end of a fluid cylinder 45 is pivotally connected to lugs 46 on rail 10. Piston rod 47, which is slidable relative to cylinder 45, is pivotally connected to bracket 48 on rail 33 of leg section 7. By retracting piston rod 47, the leg section 7 will be pivoted from the horizontal position to an over-vertical position where the leg sections extends at an angle of about 15° to the vertical, as shown in FIG. 2.

A toilet 51 is associated with the posterior section 5 of the platform and the toilet includes a generally annular seat 52, which is mounted on the upper surface of section 5 and borders an opening 53 defined by ring 8*a*. A tray 54 is mounted for sliding movement beneath opening 53 on a pair of spaced angle-shaped guides 55 that are secured to arms 8 of section 5.

As shown in FIG. 8, tray 54 is formed with a central hole 56 and a disposable bag 57, formed of plastic, or the like, is removably connected to a rim 58, which borders hole 56 by a suitable clamping band 59. With this construction, fecal material will be collected in bag 57 and the tray 54 and the attached bag can then be removed from the section 5. The clamping band 59 is then removed and the bag can then be discarded and replaced with a fresh bag.

Supporting structure 2 includes a generally horizontal housing 60 and a vertical support 61 extends upwardly from housing 60 and is connected through a flexible bellows-like connection 62 to an upper support 63. A horizontal tube 64 is secured to upper support 63 and a tube 65 extends upwardly from horizontal tube 64 and is connected through a swivel connection 66 to trolley 3. The swivel connection 66 permits the supporting structure 2 and platform 1 to be rotated relative to the guide track 4.

Trolley 3 includes a pair of wheels 68 which are connected by an axle 69. Axle 69 is attached through a bracket 67 to swivel 66. As shown in FIG. 3, wheels 68 ride on the spaced channels 71 of track 4.

In order to raise and lower the platform relative to track 4, a screw 73 is located within the supports 61 and 63 and is threaded to a nut 74 which is mounted on plate 75 of upper support 63. The lower end of screw 73 is journaled in housing 60, and as illustrated in FIG. 3, carries a gear 76 which is engaged with a pinion 77 attached to drive shaft 78 of motor 79. Through operation of motor 79, screw 73 will be rotated to move the lower support section 71 relative to upper support section 63 and thereby vary the position of platform 1 relative to track 4.

To aid in guiding the lower section 61 in movement relative to section 63, a pair of guide rods 80 are secured to housing 60 on either side of screw 73. The upper ends of guide rods 80 slide within bushings 81 mounted on plate 75, as illustrated in FIG. 9.

A trapeze bar or handle 82 can be secured to horizontal tube 64 and is spaced above platform 1. By grasping the bar 82, the patient can aid in positioning himself properly on platform 1.

In operation, platform 1 is moved manually along track 4 and rotated via the swivel connection to orient the platform over the bed 83. Through operation of motor 79, the platform is then lowered onto the bed next to the patient. As the lips, such as 18, on the platform sections are extended, the patient can be readily rolled or moved onto the platform. Lips 18, 29 and 34 are then pivoted to the upwardly inclined position to prevent the patient from rolling from the platform.

It is contemplated that a safety belt, not shown, can be associated with the posterior section to aid in securing the patient to the platform.

Platform 1 is then elevated above the bed through operation of motor 79 and the platform is then moved manually along track 4 to a location remote from the bed. Through operation of the cylinders 40 and 45, the back section can be moved upwardly and the leg section can be moved downwardly to the position as illustrated in FIG. 2, thus moving the patient to the proper position for a bowel movement.

After the bowel movement has been completed, the tray 54 is slid outwardly and the bag 57 is removed from the tray by disengaging clamping band 59 and a new bag can then be installed. The procedure can then be reversed to return the patient to the bed.

The apparatus of the invention enables a patient to be conveyed from the bed to a remote location without physical exertion either on the part of the patient or the attendant.

The invention is a compact unit which can be utilized in small rooms and does not require floor support. The mechanism can be operated by an attendant in situations where the patient has little movement, or alternately, controls can be actuated by the patient without assistance, in situations where the patient has limited movement.

Various modes of carrying out the invention are contemplated as being within the scope of the following claims particularly pointing out and distinctly claiming the subject matter which is regarded as the invention.

I claim:

1. A construction for transporting a disabled patient, comprising an elongated platform to support a patient and including a back section, a posterior section and a leg section, said sections being hingedly connected for movement between a generally horizontal position and an operative position where said posterior section is disposed generally horizontally and said back section extends upwardly from said posterior section and said leg section extends downwardly from said posterior section, a supporting structure, cantilevered support means for supporting said posterior section in cantilevered relation from said supporting structure, an overhead track, trolley means movable on the track and connected to said supporting structure, first operating means for pivoting said back section relative to said posterior section, second operating means for pivoting said leg section relative to said posterior section, said supporting structure including a first support member connected to said posterior section and a second support member connected to said trolley means, said first and second support members being movable relative to each other to vary the vertical distance between said track and said platform, drive means for moving said support members relative to each other, a horizontal beam interconnecting the upper end of said second support member and said trolley means, and handle means connected to said beam and disposed in spaced relation above said platform in position to be grasped by a patient supported on the platform.

2. The construction of claim 1, and including swivel means connecting said trolley means and said horizontal beam for enabling said supporting structure and said platform to be rotating relative to said track.

3. The construction of claim 1, wherein said posterior section includes a horizontal edge beam, a side edge of said posterior section including hook means engageable with said horizontal edge beam to removably connect said posterior section to said edge beam.

4. The construction of claim 1, wherein said first and second operating means comprises fluid cylinders.

5. The construction of claim 1, and including a toilet carried by said posterior section.

6. A construction for transporting a disabled patient, comprising an elongated platform to support a patient and including a back section, a posterior section, and a leg section, said sections being hingedly connected for movement between a generally horizontal position and an operative position where said posterior section is disposed generally horizontally and said back section extends upwardly from said posterior section and said leg section extends downwardly from said posterior section, a supporting structure, cantilevered support means for supporting said posterior section in cantilevered relation from said supporting structure, an overhead track, trolley means movable on the track and connected to said supporting structure, first operating means for pivoting said back section relative to said posterior section, second operating means for pivoting said leg section relative to said posterior section, a lip pivotally connected on the outer side edge of each platform section, each lip being movable from an extended position wherein said lip is substantially flush with said section to an angular position where said lip extends upwardly from said respective section.

7. The construction of claim 6, wherein each lip is generally wedge-shaped in cross section and terminates in an outer tapered edge.

8. The construction of claim 6, and including locking means for locking the lip in the angular position.

9. A bedside toilet construction, comprising an elongated platform to support a patient and including a back section, a posterior section, and a leg section, said sections being hingedly connected for movement between a generally horizontal position and an operative position where said posterior section is disposed generally horizontally and said back section extends upwardly from said posterior section and said leg section extends downwardly from said posterior section, a supporting structure, cantilevered support means for supporting said posterior section in cantilevered relation from said supporting structure, each of said sections including a rigid side rail, the rail of said posterior section being connected to said supporting structure and the rails of said back and leg sections being pivotally connected to the respective ends of the rail of said posterior section, each of said sections having a rigid frame with a side edge of each frame defining a downwardly facing recess to removably engage the respective rail, a toilet carried by the posterior section, and a cushion disposed on each frame to provide a solid body supporting section.

10. The construction of claim 9, wherein said toilet comprises a seat mounted on said posterior section, a tray located beneath said seat and removably mounted with respect to said posterior section, and a receptacle carried by the tray and disposed in a alignment with said seat.

11. The construction of claim 10, and including means for mounting the tray for sliding movement beneath said posterior section.

12. The construction of claim 11, wherein said receptacle comprises a plastic bag, and means for removably connecting said bag to said tray.

13. The construction of claim 9, wherein said first operating means comprises a fluid cylinder interconnecting said posterior section with said back section and said operating means comprises a second fluid cylinder connecting said posterior section with said leg section.

14. The construction of claim 9, wherein each frame comprises a plurality of spaced parallel arms and an end of each arm has a hook-like member defining said recess.

15. The construction of claim 9, and including a lip pivotally connected to the outer side edge of each section, each lip being movable from an extended position where said lip is substantially flush with said section to an angular position wherein said lip extends upwardly from the respective section.

16. The construction of claim 15, wherein each lip is generally wedge-shaped in cross-section and terminates in an outer tapered edge, said construction also including locking means for locking the lip in the angular position.

* * * * *